United States Patent [19]

Cellini

[11] Patent Number: 5,007,310

[45] Date of Patent: Apr. 16, 1991

[54] SCREW WITH DIFFERENTIATED SECTIONS FOR CORKSCREWS

[76] Inventor: Ferdinando Cellini, Via Percoto 11, Maniago (PN), Italy, 33085

[21] Appl. No.: 474,303

[22] Filed: Feb. 5, 1990

Related U.S. Application Data

[63] Continuation of Ser. No. 283,833, Dec. 13, 1988, abandoned.

[30] Foreign Application Priority Data

Dec. 22, 1987 [IT] Italy ..... 83517 A/87

[51] Int. Cl.[5] ..... B67B 7/00

[52] U.S. Cl. ..... 81/3.45; 81/3.07; 7/155

[58] Field of Search ..... 81/3.45, 3.07; 7/155

[56] References Cited

U.S. PATENT DOCUMENTS

| | | | |
|---|---|---|---|
| D. 47,778 | 8/1915 | Yapczenski | 7/155 |
| 251,525 | 12/1881 | Codd | 81/3.45 |
| 647,775 | 4/1900 | Walker | 7/155 |
| 1,548,519 | 8/1925 | Flint | 81/3.45 |

FOREIGN PATENT DOCUMENTS

| | | | |
|---|---|---|---|
| 0143475 | 9/1984 | European Pat. Off. . | |
| 98 | 7/1877 | Fed. Rep. of Germany . | |
| 48166 | 12/1888 | Fed. Rep. of Germany . | |
| 0009531 | of 1881 | United Kingdom | 81/3.45 |
| 12959 | of 1913 | United Kingdom . | |
| 0483425 | 4/1938 | United Kingdom | 81/3.45 |

*Primary Examiner*—Frederick R. Schmidt
*Assistant Examiner*—Lawrence Cruz
*Attorney, Agent, or Firm*—Wegner, Cantor, Mueller & Player

[57] ABSTRACT

Screw (15) with differentiated sections for corkscrews (10) which consists of a pivotal (14) element (17) for connection to a lever body (11) of the corkscrew (10), a screw body (18) formed with a plurality of helices (19) and a point (20), the screw body (18) comprising at least two segments of a desired length (L1–L2), which contain a desired number (n1–n2) of helices (19) and consist of helics (19) having sections of a differentiated size (S1–S2), the section S2 being smaller than the section S1 by a desired value.

3 Claims, 1 Drawing Sheet

SCREW WITH DIFFERENTIATED SECTIONS FOR CORKSCREWS

This application is a continuation of U.S. application Ser. No. 283,833, filed Dec. 13, 1988 now abandoned.

This invention concerns a screw with differentiated sections for corkscrews. To be more exact, the invention concerns a screw which is suitable to engage corks and has sections of a differentiated diameter that decreases, starting from the pivot connecting the screw to the corkscrew lever body.

Corkscrew screws having a great variety of dimensions are known in the state of the art. They posses in common a pointed terminal portion to be inserted into the cork and a body consisting of a plurality of metallic helices ending in a pivot element which connects them to the corkscrew lever body, this connection being of a pivotal type.

The body of many known screws has helices of a constant section, the value of the section depending on the maker's choice.

If the section is of a relatively small size, it enables the screw to penetrate readily into the cork and the cork to be drawn easily from the bottom since the pressure exerted on the neck of the bottle by the layers of cork displaced sideways during penetration of the screw in relatively small.

However, a section of this type may entail the drawback of not being strong enough, particularly so in the case of lever type corkscrews where the cork is drawn in a non-axial manner.

Strains or breakages may occur generally, particularly at the element connecting the screw to the corkscrew lever body.

Screws of a relatively great section may entail problems of the opposite kind.

The body of other known screws comprises sections of a progressively decreasing size, starting from the element connecting the screw to the corkscrew lever body and continuing up to the point of the screw.

Embodiments of this type are disclosed, for instance, in GB-A-12959, DE-C-48166 and DE-C-98. These embodiments, however, do not enable a proper balance between the required strength and the ability of the screw to penetrate into the cork to be obtained.

So as to overcome the problems of the state of the art the present applicant has set himself the aim of embodying a screw for corkscrews which ensures at one and the same time a ready penetration into the cork and an easy drawing thereof and also enough strength to withstand the non-axial forces exerted on the screw during the drawing of the cork.

This aim is achieved with the invention disclosed in claim 1; according to the invention the screw comprises helices of its body which have sections of at least two differentiated sizes.

One portion of helices adjacent to the pivot element connecting the screw to the lever body has a greater section, whereas the other portion of helices towards the point of the screw has a smaller section.

The ratio between the number of helices having a greater section and the number of helices having a smaller section depends on the dimensional features of the screw as a whole and on the type of corkscrew on which the screw is to be used.

The same is true as regards the ratio between the value of the greater section and that of the smaller section.

The attached figures, which are given as a non-restrictive example, show the following:

Figure 1:
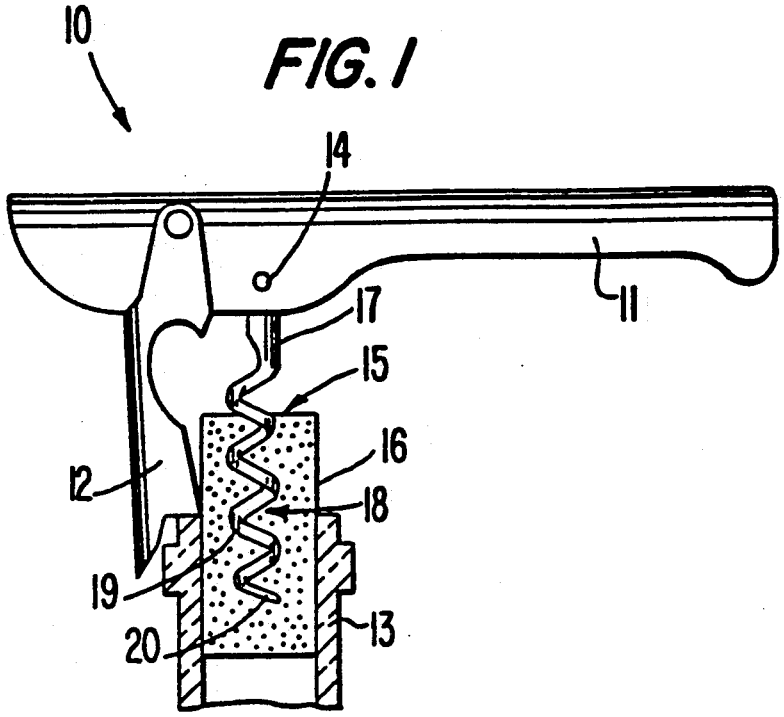
FIG. 1 shows a lever-type corkscrew which employs a screw according to the invention.

In FIG. 1 a lever-type corkscrew 10 comprises a lever body 11 and a support element 12 able to cooperate with a neck 13 of a bottle.

A screw 15 to draw a cork 16 from the neck 13 of the bottle is connected to and pivoted 14 on the lever body 11. The screw 15 comprises a connecting element 17 for connection at the pivot 14 to the lever body 11, a screw body 18 consisting of a plurality of helices 19 and a terminal point 20.

Figure 2:
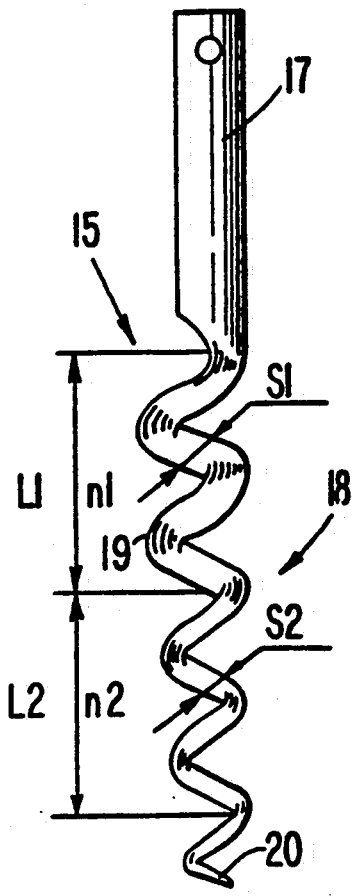
FIG. 2 shows a screw according to the invention.

FIG. 2 shows a screw 15 according to the invention, in which the screw body 18 consists of helices 19 having a section Sl along a desired length Ll of the screw body 18 and having a desired number nl of helices 19, and of helices having a desired section S along a desired length L2 of the screw body 18 and having a desired number n2 of helices 19, the section S2 being smaller than the section Sl by a required value.

In this example the sections Sl and S2 are circular in shape but can be of any other possible shape, square for instance, and may also be different from each other, Sl being square and S2 circular for instance, depending on the requirements of construction and application.

I claim:

1. A corkscrew comprising:

a lever body;

a support element; and an elongate member pivotally connected to said lever body and comprising a helix portion formed into a plurality of helices, having:

a point at the distal end thereof; and at least a first segment comprising at least one helix and a second segment comprising at least one helix, said second segment being closer to said distal end of said elongate member than said first segment; wherein a cross-section of said elongated member in said first segment is constant and has a first width, and a cross-section of said elongate member in said second segment is constant and has a second width; and wherein said second width is smaller than said first width.

2. A corkscrew as claimed in claim 1, wherein a combined length of said first segment and said second segment is substantially equal to the length of said helix portion of the elongate member.

3. A corkscrew as claimed in claim 2, wherein said first segment and said second segment are equal in length.

* * * * *